US008383546B2

(12) United States Patent
Inaba et al.

(10) Patent No.: US 8,383,546 B2
(45) Date of Patent: Feb. 26, 2013

(54) HEAT-SENSITIVE TRANSFER IMAGE-RECEIVING SHEET

(75) Inventors: Hiroo Inaba, Minami-ashigara (JP); Naotsugu Muro, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 346 days.

(21) Appl. No.: 12/894,024

(22) Filed: Sep. 29, 2010

(65) Prior Publication Data

US 2011/0076428 A1 Mar. 31, 2011

(30) Foreign Application Priority Data

Sep. 29, 2009 (JP) ..... 2009-225402

(51) Int. Cl.
*B41M 5/50* (2006.01)

(52) U.S. Cl. ..... 503/227; 428/32.39
(58) Field of Classification Search ..... None
See application file for complete search history.

(56) References Cited

FOREIGN PATENT DOCUMENTS

| | | | |
|---|---|---|---|
| JP | 2008-105366 | A | 5/2008 |
| JP | 2008-162155 | A | 7/2008 |
| JP | 2009-83273 | A | 4/2009 |

*Primary Examiner* — Bruce H Hess
(74) *Attorney, Agent, or Firm* — Sughure Mion, PLLC

(57) ABSTRACT

A heat-sensitive transfer image-receiving sheet, having on a support: at least one heat insulation layer and at least one receptor layer containing a vinyl chloride-series latex copolymer in this order, in which at least one intermediate layer is provided between the heat insulation layer and the receptor layer, the total dry film thickness of the receptor layer and the intermediate layer is 2.5 to 4.0 μm, and the intermediate layer contains 90 mass % or more of a polymer having a glass transition temperature of 30° C. or higher.

7 Claims, 1 Drawing Sheet

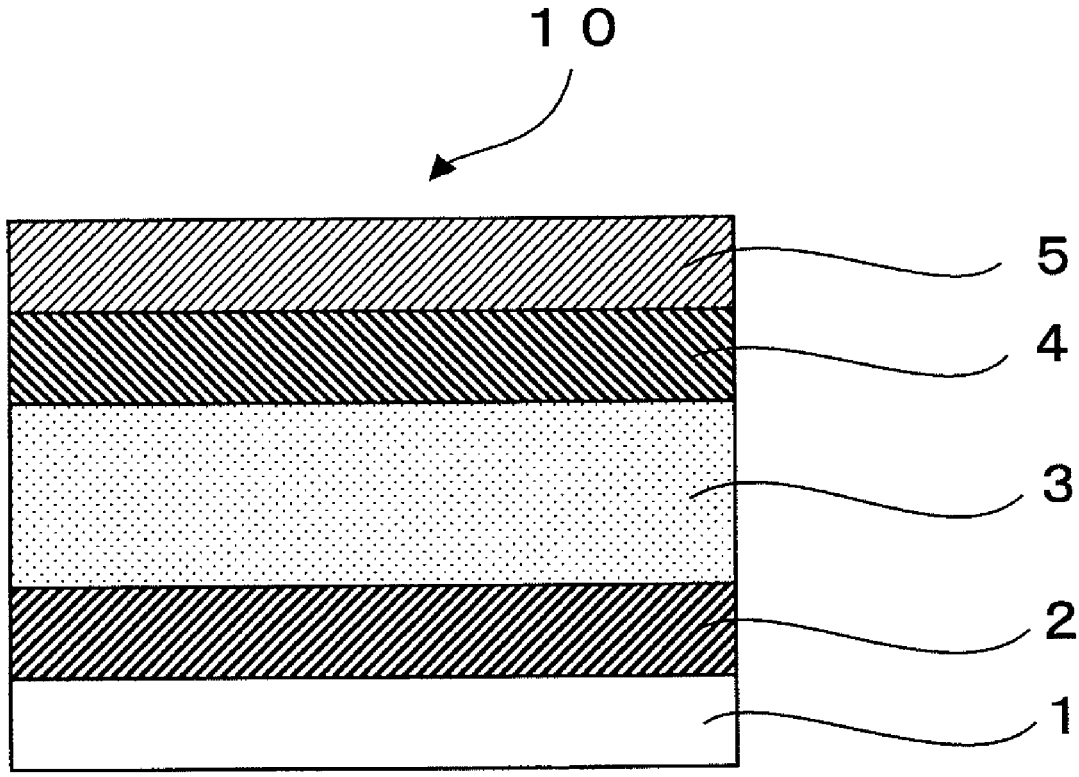
10
5
4
3
2
1

HEAT-SENSITIVE TRANSFER IMAGE-RECEIVING SHEET

FIELD OF THE INVENTION

The present invention relates to a heat-sensitive transfer image-receiving sheet used in a dye diffusion transfer recording.

BACKGROUND OF THE INVENTION

In a dye diffusion transfer recording system, a heat-sensitive transfer sheet (hereinafter simply also referred to as an ink sheet) containing a colorant (hereinafter simply also referred to as a dye) is superposed on a heat-sensitive transfer image-receiving sheet (hereinafter simply also referred to as an image-receiving sheet), and then the heat-sensitive transfer sheet is heated by a thermal head whose exothermic action is controlled by electric signals, in order to transfer the dyes contained in the heat-sensitive transfer sheet to the image-receiving sheet, thereby recording an image information. Three colors: cyan, magenta, and yellow, or four colors which consist of the three colors and black are used for recording a color image by overlapping one color to other, thereby enabling transferring and recording a color image having continuous gradation for color densities.

As a method to obtain a thermal transfer image-receiving sheet, for example there is a known method in which a heat insulation layer and a receptor layer are sequentially formed on a substrate sheet by a gravure coat or the like. However, in this method, since each layer is sequentially formed, there is a problem that a number of steps is increased. Thus, in order to obtain the thermal transfer image-receiving sheet with a small number of the steps, a method or the like, in which layers are simultaneously formed, attracts an attention.

For example, as described below, there are known heat transfer image-receiving sheets, which are produced by simultaneously multilayer-coating the coating liquids (aqueous coating) for each layer on a support.

JP-A-2008-105366 ("JP-A" means unexamined published Japanese patent application) discloses an aqueous heat transfer image-receiving sheet, provided on a substrate sheet, with a porous layer (heat insulation layer) that imparts a heat insulation property, a primer layer (intermediate layer) that enhances the adhesiveness between the porous layer and a receptor layer and improves the surface property of the receptor layer, and the receptor layer, by a slide coating method.

JP-A-2008-162155 discloses that a primer layer is similarly provided between a receptor layer and a porous layer, but is characterized by providing the receptor layer by a solvent system.

JP-A-2009-83273 discloses a heat transfer image-receiving sheet provided with a substrate sheet, a porous layer containing a cooling gelling agent, and a receptor layer in this order, in which a cushion layer containing an SBR resin and a gelatin is provided in at least one of the site between the substrate sheet and the porous layer and the site between the porous layer and the receptor layer.

In the case where the heat insulation layer of the heat-sensitive transfer image-receiving sheet is constructed by the aqueous coating, it is necessary to fill the heat insulation layer with foamed hollow particles as far as possible, in order to secure a desired heat insulation property. However, if the content of the hollow particles is increased, the heat insulation layer is weakened and a cushioning property is decreased, and in addition, the disturbance at the interface between the heat insulation layer and the layer disposed thereon, is increased.

There is known a heat-sensitive transfer image-receiving sheet having the intermediate layer disposed between the receptor layer and the heat insulation layer such as described above, so as to mitigate the disturbance at the interface. However, in that case, the insertion of one intermediate layer inevitably causes an enlargement of the distance from the outermost surface of the receptor layer to the heat insulation layer. For that reason, the heat insulation property upon printing is weakened, and thereby the amount of dye transfer is decreased. Thus, the heat-sensitive transfer image-receiving sheet is unsuitable for a high speed image printing.

Furthermore, it has been preferable traditionally or in low speed printers such as sublimation type printers for consumer use, that the glass transition temperature (Tg) of a polymer in the intermediate layer is rather lower. However, in sublimation type printers for business in recent years, the temperature of the thermal head is set high, concomitantly with an acceleration of a printing speed. Thus, if the glass transition temperature (Tg) of the polymer in the intermediate layer is low, there occurs a problem that the intermediate layer is softened by the heat transferred from the head and loses its elasticity, and as a result, the pressure exerted on the hollow particles in the heat insulation layer is increased, causing destruction of the hollow particles and a consequent decrease in a sensitivity.

In the sublimation type printers, the heat-sensitive transfer image-receiving sheet is pressed from the rear side against the thermal head with a rubber roller called platen roller, in order to increase the adhesiveness among the transfer sheet, the image-receiving sheet and the thermal head. There is also a problem that, along with an increase in the number of printed sheets, the circularity of the platen roller is decreased, and the unevenness of the pressure that is exerted on the thermal head is increased, and color unevenness strongly appears in a longitudinal direction.

SUMMARY OF THE INVENTION

The present invention resides in a heat-sensitive transfer image-receiving sheet, having on a support:

at least one heat insulation layer; and at least one receptor layer containing a vinyl chloride-series latex copolymer in this order, wherein at least one intermediate layer is provided between the heat insulation layer and the receptor layer, wherein the total dry film thickness of the receptor layer and the intermediate layer is 2.5 to 4.0 μm, and wherein the intermediate layer contains 90 mass % or more of a polymer having a glass transition temperature of 30° C. or higher.

Other and further features and advantages of the invention will appear more fully from the following description, appropriately referring to the accompanying drawings.

BRIEF DESCRIPTION OF THE DRAWINGS

FIG. 1 is a cross-sectional view showing a preferred embodiment of the heat-sensitive transfer image-receiving sheet of the present invention.

DETAILED DESCRIPTION OF THE INVENTION

According to the present invention, there is provided the following means:

(1) A heat-sensitive transfer image-receiving sheet, having on a support:

at least one heat insulation layer; and at least one receptor layer containing a vinyl chloride-series latex copolymer in this order, wherein at least one intermediate layer is provided between the heat insulation layer and the receptor layer, wherein the total dry film thickness of the receptor layer and the intermediate layer is 2.5 to 4.0 μm, and wherein the intermediate layer contains 90 mass % or more of a polymer having a glass transition temperature of 30° C. or higher.

(2) The heat-sensitive transfer image-receiving sheet as described in the above item (1), wherein the polymer having a glass transition temperature of 30° C. or higher is at least one selected from the group consisting of a resin containing a butadiene structure compound as a repeating unit and a polyester resin.

(3) The heat-sensitive transfer image-receiving sheet as described in the above item (1) or (2), wherein the polymer having a glass transition temperature of 30° C. or higher is a styrene-butadiene rubber.

(4) The heat-sensitive transfer image-receiving sheet as described in any one of the above items (1) to (3), wherein the dry film thickness of the intermediate layer is 2.1 to 3.0 μm.

(5) The heat-sensitive transfer image-receiving sheet as described in any one of the above items (1) to (4), wherein the glass transition temperature of the vinyl chloride-series latex copolymer is from 50° C. to 100° C.

(6) The heat-sensitive transfer image-receiving sheet as described in any one of the above items (1) to (5), having a subbing layer between the support and the heat insulation layer.

(7) The heat-sensitive transfer image-receiving sheet as described in any one of the above items (1) to (6), wherein the intermediate layer contains a gelatin.

[Heat-Sensitive Transfer Image-Receiving Sheet]

The heat-sensitive transfer image-receiving sheet of the present invention is explained in detail below.

The heat-sensitive transfer image-receiving sheet of the present invention (hereinafter, also referred to as image-receiving sheet of the present invention) is a heat-sensitive transfer image-receiving sheet having at least one heat insulation layer and at least one receptor layer on a support in this order, and further having at least one intermediate layer between the heat insulation layer and the receptor layer.

The heat-sensitive transfer image-receiving sheet of the present invention is such that the total dry film thickness of the receptor layer and the intermediate layer is 2.5 to 4.0 μm.

If the total dry film thickness of the receptor layer and the intermediate layer is less than 2.5 μm, the color unevenness caused by the platen roller is poor, and if the thickness exceeds 4.0 μm, a sufficient dye transfer density is not obtained. The total dry film thickness of the receptor layer and the intermediate layer is preferably 2.7 to 4.0 μm, and more preferably 2.9 to 3.8 μm.

<Receptor Layer>

The image-receiving sheet of the present invention has at least one receptor layer containing a vinyl chloride-series latex copolymer. The receptor layer plays a role of being dyed with a dye migrated from the heat-sensitive transfer sheet and maintaining a formed image.

(Vinyl Chloride-Series Latex Copolymer)

In the present specification, the vinyl chloride-series copolymer is a copolymer prepared with a vinyl chloride as a polymerization monomer and an other monomer, and examples thereof include vinyl chloride-vinyl acetate copolymers, vinyl chloride-acrylate copolymers, vinyl chloride-methacrylate copolymers, vinyl chloride-vinyl acetate-acrylate copolymers, and vinyl chloride-acrylate-ethylene copolymers. As described above, the copolymer may be a binary copolymer or a ternary or higher copolymer, and the monomers may be distributed randomly or uniformly, or the copolymer may be a block copolymer.

The copolymers may contain auxiliary monomer components such as vinylalcohol derivatives, maleic acid derivatives, and vinyl ether derivatives.

It is preferable that the vinyl chloride-series copolymer used in the present invention contains a vinyl chloride as a main component. The phrase "contain a vinyl chloride as a main component" means that the vinyl chloride component is contained at a proportion of 50% by mole or more, and it is preferable that the vinyl chloride component is contained at a proportion of 50% by mole or more, and it is preferable that the auxiliary monomer components such as a maleic acid derivative and a vinyl ether derivative are contained at a proportion of 10% by mole or less.

By incorporating the vinyl chloride-series latex copolymer into the receptor layer, a high dye transfer density can be obtained.

In the present invention, it is preferable that the vinyl chloride-series latex copolymer used in the receptor layer has a higher glass transition temperature (Tg) than that of the polymer having a glass transition temperature of 30° C. or higher, which is used in the intermediate layer, from the viewpoint of the color unevenness caused by the platen roller. Particularly, the glass transition temperature (Tg) of the vinyl chloride-series latex copolymer is preferably from 50° C. to 100° C., more preferably from 60° C. to 100° C., and most preferably from 70° C. to 90° C.

The glass transition temperature (Tg), if not practically measurable, may be calculated according to the following formula:

$$1/Tg=\Sigma(Xi/Tgi)$$

wherein, assuming that the polymer is a copolymer composed of n monomers from i=1 to i=n; Xi is a mass fraction of the i-th monomer ($\Sigma Xi=1$) and Tgi is a glass transition temperature (measured in absolute temperature) of a homopolymer formed from the i-th monomer; the symbol Σ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

The vinyl chloride-series latex copolymer preferably used in the present invention is such that the polymer concentration is preferably 10 to 70% by mass, and more preferably 20 to 60% by mass, based on the latex liquid. The total addition amount of the latex polymer in the receptor layer is such that the solid content of the latex polymer is preferably 50 to 98% by mass, and more preferably 70 to 95% by mass, based on the total amount of the polymer in the receptor layer.

Examples of the vinyl chloride-series latex copolymer include VINYBLAN 603, VINYBLAN 683, VINYBLAN 900, VINYBLAN 901, and VINYBLAN 902 (trade names, manufactured by Nissin Chemical Industry Co., Ltd.). These are preferable in the present invention.

(Water-Soluble Polymer)

The image-receiving sheet of the present invention may contain a water-soluble polymer in the receptor layer. A gelatin, a polyvinyl alcohol, a polyvinylpyrrolidone, and a polyvinylpyrrolidone copolymer are preferably used. Among them, the gelatin is preferably used, for the reason that gelatin has a good setting property at the time of coating. These water-soluble polymers are effective in controlling a hydrophilicity and a hydrophobicity of the receptor layer, and if the water-soluble polymer is used in a non-excessive amount, a dye transfer from the ink sheet is good, and also, a transfer density is good.

The amount of use of the water-soluble polymer is preferably 0.1 to 10% by mass, and more preferably 0.5 to 5% by mass, relative to the total mass of the solid content in the receptor layer.

(Polyether-Modified Silicone)

In the image-receiving sheet of the present invention, it is preferable that the receptor layer contains a polyether-modified silicone, from the viewpoint of a releasing property. The polyether-modified silicone is preferably a liquid at 25° C. It is also preferable that the polyether-modified silicone is a non-reactive compound and do not contain an epoxy group.

The polyether-modified silicone preferably used in the present invention is preferably a single-terminal-modified type silicone represented by the following formula (1), a both-terminal-modified type silicone represented by the following formula (2), a side chain-modified type silicone represented by the following formula (3), or a main chain copolymer type silicone represented by the following formula (4).

Formula (1)

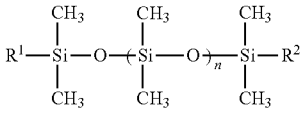

Formula (2)

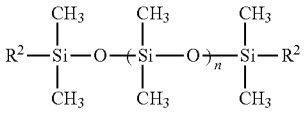

Formula (3)

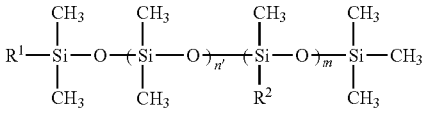

Formula (4)

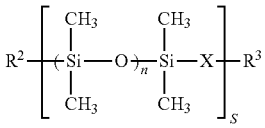

In the formulae (1) to (4), $R^1$ represents an alkyl group; $R^2$ represents —Y—$(C_2H_4O)_a$—$(C_3H_6O)_b$—$R^4$; $R^3$ represents a hydrogen atom, an acyl group having a acyl moiety, an alkyl group, a cycloalkyl group, and an aryl group; $R^4$ each independently represents a hydrogen atom, an acyl group, an alkyl group, a cycloalkyl group, and an aryl group; Y represents a single bond or a divalent linking group; X represents a divalent linking group; n represents a positive number; n' and m represent a positive number; s represents a positive number; a and b each independently represents 0 or a positive number but a and b are not 0 at the same time.

The alkyl group represented by $R^1$ may represent a branched alkyl group. The alkyl group represented by $R^1$ is preferably an alkyl group having 1 to 20 carbon atoms, more preferably 1 to 8 carbon atoms, still more preferably 1 to 4 carbon atoms. Among them, a methyl group and an ethyl group are preferable and a methyl group is most preferable.

The acyl group having an acyl moiety represented by $R^3$ includes, for example, an acetyl group, a propionyl group, a buthylyl group, and a benzoyl group. Among these acyl groups, an acyl group having 2 to 20 carbon atoms is preferable and an acyl group having 2 to 10 carbon atoms is more preferable.

The alkyl group represented by $R^3$ includes, for example, a methyl group, an ethyl group, a propyl group, an isopropyl group, a buthyl group, and a tert-buthyl group. The alkyl group is preferably an alkyl group having 1 to 20 carbon atoms, more preferably 1 to 10.

The cycloalkyl group represented by $R^3$ includes, for example, a cyclopenthyl group and a cyclohexyl group. The cycloalkyl group is preferably a cycloalkyl group having 5 to 10 carbon atoms.

The aryl group represented by $R^3$ includes, for example, a phenyl group and a naphthyl group. An aryl moiety of the aryl group is preferably a benzene ring.

$R^3$ preferably represents an alkyl group.

The acyl group represented by $R^4$ is preferably an acyl group having 20 or less carbon atoms, more preferably 10 or less, still more preferably 5 or less, most preferably an acethyl group.

The alkyl group represented by $R^4$ may represent a branched alkyl group. The alkyl group represented by $R^4$ is preferably an alkyl group having 1 to 20 carbon atoms, more preferably 1 to 8, still more preferably 1 to 4. Among them, a methyl group, an ethyl group, and a buthyl group are preferable, and a methyl group is most preferable.

The cycloalkyl group represented by $R^4$ is preferably a cyclopentyl group and a cyclohexyl group.

The aryl group represented by $R^4$ may have a substituent, and includes, for example, a phenyl group and a naphtyl group, and preferably a phenyl group. The substituent preferably includes, for example, an alkyl group and a halogen atom. An unsubstituted phenyl group is most preferable.

$R^4$ preferably represents a hydrogen atom, an acyl group, an alkyl group and an aryl group. Among them, a hydrogen atom, an acyl group and an alkyl group are more preferable, and an alkyl group is still more preferable.

The divalent linking groups represented by X and Y each independently preferably represents an alkylene group and an alkyleneoxy group. The alkylene group preferably includes, for example, a methylene group, an ethylene group, and a propylene group. The alkyleneoxy group preferably includes, for example, —$CH_2CH_2O$—, —$CH(CH_3)CH_2O$—, —$CH_2CH(CH_3)O$—, and —$(CH_2)_3O$—. The divalent linking group preferably has 1 to 4 carbon atoms and more preferably 2 or 3.

In addition, X and Y preferably represent a single bond and the preferred divalent linking group.

More preferably, Y represents an alkyleneoxy group, most preferably, Y represents a propyleneoxy group (—$(CH_2)_3O$—).

a and b each independently preferably represents 0 or an integer of 1 or more, more preferably 0 to 500, still more preferably 0 to 200.

n preferably represents 1 to 1,000. n' and m preferably represent 0 to 1,000.

s preferably represents 1 to 10, more preferably 1 to 6, still more preferably 1 to 4.

Among the polyether-modified silicones represented by the formulas (1) to (4), the polyether-modified silicones represented by the formulas (2) to (4) are preferred, in view of a releasing action, and the polyether-modified silicones represented by the formulas (2) or (3) are more preferred, and the polyether-modified silicone represented by the formula (3) is most preferred.

The polyether-modified silicone is such that an HLB (Hydrophile-Lipophile Balance) value is preferably 5 to 9, and more preferably 5 to 7.

In the present invention, the HLB value is determined by a calculation formula defined by the following expression, based on the Griffin's method, ("Kaimennkasseizaibinnrann (Handbook of Surfactant)," co-authored by Ichiro Nishi, Tooziro Imai and Masai Kasai, published by Sangyo Tosho Co., Ltd., 1960).

$$HLB=20\times Mw/M$$

Herein, M represents a molecular weight, and Mw represents the formula weight (molecular weight) of the hydrophilic moiety. In addition, M=Mw+Mo, wherein Mo is the formula weight (molecular weight) of the lipophilic moiety. The hydrophilic moiety in this case is an ethyleneoxy group.

Specific examples of a silicone oil of the polyether-modified silicone oil preferably used in the present invention include KF-351A, KF-352A, KF-353, KF354L, KF-355A, KF-615A, KF-945, KF-640, KF-642, KF-643, KF-6020, KF-6011, KF-6012, KF-6015, KF-6017, X-22-4515, and X-22-6191, manufactured by Shin-Etsu Chemical Co., Ltd.; SH3749, SH3773M, SH8400, SF8427, SF8428, FZ-2101, FZ-2104, FZ-2110, FZ-2118, FZ-2162, FZ-2203, FZ-2207, FZ-2208, FZ-77, L-7001, and L-7002, manufactured by Dow Corning Toray Co., Ltd. (all trade names).

The polyether-modified silicone oil preferably used in the present invention can be easily synthesized by the methods described in, for example, JP-A-2002-179797, JP-A-2008-1896, and JP-A-2008-1897, or methods equivalent to these methods.

In the present invention, the polyether-modified silicone oil can be used singly, or in combination of two or more kinds thereof can also be used. Also, in the present invention, the other releasing agent may be used in combination with the polyether-modified silicone oil.

The addition amount of the polyether-modified silicone oil is preferably 1% by mass to 20% by mass, and more preferably 1% by mass to 10% by mass, based on the total amount of the latex polymer in the receptor layer.

The coating amount of the receptor layer in the present invention is preferably 0.5 to 10.0 g/m$^2$, and more preferably 1.0 to 8.0 g/m$^2$. The term "coating amount" in the present specification is a value calculated in terms of the solid content, unless particularly stated otherwise.

<Intermediate layer>

The heat-sensitive transfer image-receiving sheet of the present invention has at least one intermediate layer between the heat insulation layer and the receptor layer, and the intermediate layer contains 90% by mass or more of a polymer having a glass transition temperature of 30° C. or higher.

When the glass transition temperature (Tg) of the polymer is less than 30° C., the intermediate layer is softened by a heat applied from the thermal head and loses an elasticity. Thus, the color unevenness caused by a variation in the pressing pressure of the platen roller cannot be improved. Especially, in order to maintain a heat resistance, the glass transition temperature (Tg) of the polymer having a glass transition temperature of 30° C. or higher is preferably from 30° C. to 80° C., more preferably from 30° C. to 60° C., and most preferably from 35° C. to 45° C.

The polymer having a glass transition temperature of 30° C. or higher is contained in the intermediate layer in an amount of 90% by mass or more, and it is preferable that the polymer is contained in an amount of from 90% by mass to 95% by mass. If the content of the polymer having a glass transition temperature of 30° C. or higher in the intermediate layer is less than 90% by mass, the intermediate layer is softened by the heat applied from the thermal head and loses the elasticity, and thus, the occurrence of the color unevenness caused by the platen roller cannot be improved. Herein, this content is a content obtainable in a dried film state.

Examples of the polymer having a glass transition temperature of 30° C. or higher, that is preferably used in the present invention, include the following resins.

(Resin Containing Butadiene as Repeating Unit)

Examples of the resin containing a butadiene as a repeating unit, which has a Tg of 30° C. or higher, include a styrene-butadiene copolymer (styrene-butadiene rubber (SBR)), an acrylonitrile-butadiene copolymer (NBR latex), a methyl methacrylate-butadiene copolymer (MBR latex), and a styrene-butadiene-acrylic copolymer. Among these, SBR, NBR and MBR are preferred, and SBR is most preferred from the viewpoint of maintaining the elasticity of the heated intermediate layer. Furthermore, an SBR latex can be preferably used as the SBR.

These resins can be used singly or as mixtures of two or more kinds thereof, according to the necessity.

Specific examples of the resin containing a butadiene as a repeating unit, which has a Tg of 30° C. or higher, include SR-115 (trade name, manufactured by NIPPON A & L INC.); and Nipol 2507H, LX416 and LX433C (trade names, manufactured by Nippon Zeon).

(Polyester Resin)

The polyester resin having a Tg of 30° C. or higher contains a dicarboxylic acid component such as a terephthalic acid, an isophthalic acid, a phthalic acid, and a naphthalenedicarboxylic acid; and a diol component such as an ethylene glycol, a neopentyl glycol, a bisphenol A, a butylene glycol, and a hexanediol. An aromatic dicarboxylic acid component such as a terephthalic acid is contained in an amount of preferably from 30 mol % to 70 mol %, and more preferably from 40 mol % to 60 mol %, based on the total amount of the dicarboxylic acids.

Furthermore, for the diol component, it is preferable to use a neopentyl glycol, a bisphenol A or the like, in addition to an ethylene glycol, and it is preferable that the content of an ethylene glycol is limited to 40 mol % or less, and more preferably 20 mol % or less, based on the total amount of the polymer.

The weight average molecular weight of the polyester resin is preferably from 30,000 to 100,000, and more preferably from 45,000 to 80,000.

A polyester-series latex polymer may be used, and examples thereof include VYLONAL MD1100 1200, VYLONAL MD1220, VYLONAL MD1245, VYLONAL MD1250, and VYLONAL MD1500 (trade names, manufactured by Toyobo Co., Ltd.).

The resin containing a butadiene as a repeating unit is preferable, compared with the polyester resin, from the viewpoint of the color unevenness caused by the platen roller.

<Heat Insulation Layer>

The heat-sensitive transfer image-receiving sheet of the present invention contains at least one heat insulation layer. The heat insulation layer may be a single layer or double or more multiple layers. The heat insulation layer is formed between the receptor layer and the support.

(Hollow Polymer Particles)

In the present invention, the heat insulation layer preferably contains hollow polymer particles.

The hollow polymer particles (hereinafter, also referred to as hollow particles) in the present invention are polymer particles having voids inside of the particles. The hollow polymer particles are preferably an aqueous dispersion.

Examples of the hollow polymer particles include (1) non-foaming type hollow particles obtained in the following manner: a dispersion medium such as water is contained inside of a capsule wall formed of a polystyrene, an acrylic resin, a styrene/acrylic resin or the like, and, after a coating liquid is applied and dried, the water in the particles is vaporized out of the particles, with the result that the inside of each particle forms a hollow; (2) foaming type microballoons obtained in the following manner: a low-boiling-point liquid such as a butane and a pentane, is encapsulated in a resin constituted of any one of a polyvinylidene chloride, a polyacrylonitrile, a polyacrylic acid, and a polyacrylate, or their mixture or polymer, and after coating, it is heated to expand the low-boiling-point liquid inside of the particles, whereby the inside of each particle is made to be hollow; and (3) microballoons obtained by foaming the above (2) under heating in advance, to make hollow polymer particles.

Of these, non-foaming hollow polymer particles of the foregoing (1) are preferred. If necessary, use can be made of a mixture of two or more kinds thereof. Specific examples include Rohpake HP-1055, manufactured by Rohm and Haas Co.; SX866(B), manufactured by JSR Corporation; and Nipol MHS5055, manufactured by Nippon Zeon (all trade names).

The average particle diameter (particle size) of the hollow polymer particles is preferably 0.5 to 5.0 μm, more preferably 0.5 to 2.0 μm. If the average particle size of the hollow particles is not too small, a film (layer) can be designed to have a high void ratio (porosity ratio) so that a high heat insulation property is obtained. If the average particle size of the hollow particles is not too large, collapse of the hollow particles due to a film contraction during a drying step upon producing does not occur easily.

The average particle size of the hollow polymer particles used in the present invention is calculated after measurement of the circle-equivalent diameter of the periphery of particle under a transmission electron microscope. The average particle diameter is determined by measuring a circle-equivalent diameter of the periphery of at least 300 hollow polymer particles observed under the transmission electron microscope and obtaining the average thereof.

The hollow particles used in the present invention are such that the void ratio (hollow ratio) is preferably about 20 to 80%, and more preferably about 30 to 70%. If the hollow ratio is not too low, a high heat insulation property is obtained. On the other hand, if the hollow ratio is not too high, there occurs no decrease in the strength of the hollow particles, and a collapse of the hollow particles due to the film contraction during the drying step upon producing does not occur easily.

The hollow ratio of the hollow particles used in the present invention can be determined by observing at least 300 hollow particles using the transmission electron microscope, computing an average circle-equivalent diameter (R1) of the outer diameters and an average circle-equivalent diameter (R2) of the inner diameters, and calculating the volume ratio of a void portion to a particle volume, $(R2/R1)^3 \times 100$.

The glass transition temperature (Tg) of the hollow polymer particles is preferably 70° C. or more and 200° C. or less, more preferably 90° C. or more and 180° C. or less. As the hollow particles, it is particularly preferable to use a hollow polymer particle latex such as a latex polymer having hollow particles dispersed in water.

In the image-receiving sheet of the present invention, the ratio of the total volume of the hollow particles occupying in the total volume of the heat insulation layer is preferably 30% to 90%, and more preferably 50% to 80%.

The ratio of the total solid content of the hollow particles occupying in the total solid content of the heat insulation layer is preferably 20% by mass to 80% by mass, and more preferably 30% by mass to 70% by mass.

In the present invention, in the case where there are two or more heat insulation layers, for example, it is preferable embodiment that the heat insulation layers is divided into an upper heat insulation layer and a lower heat insulation layer.

(Gelatin)

In the present invention, it is preferable that the heat insulation layer contains a gelatin. The gelatin used in the present invention may be any of a so-called alkali-treated (lime-treated) gelatin obtained by immersing the gelatin in an alkali bath, an acid-treated gelatin obtained by immersing the gelatin in an acid bath, a double-immersed gelatin obtained by immersing the gelatin in both of the alkali bath and the acid bath, and an enzyme-treated gelatin before gelatin extraction in the production process. A gelatin having a molecular weight of 10,000 to 1,000,000 may be used in the present invention. The gelatin that can be used in the present invention may contain an anion such as $Cl^-$ and $SO_4^{2-}$, and may contain a cation such as $Fe^{2+}$, $Ca^{2+}$, $Mg^{2+}$, $Sn^{2+}$, and $Zn^{2+}$. The gelatin is preferably added as an aqueous solution.

(Water-Soluble Polymer Other than Gelatin)

In the present invention, the insulating layer may contain a water-soluble polymer other than the gelatin. The water-soluble polymer which can be used in the present invention other than the gelatin includes natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses and the like derived from plant as starting materials, which will be explained later, correspond to the water-soluble polymer usable in the present invention.

Among the water-soluble polymers other than the gelatin which can be used in the present invention, the natural polymers and the semi-synthetic polymers will be explained in detail. Specific examples include the following polymers: plant type polysaccharides such as gum arabics, κ-carrageenans, Λ-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the water-soluble polymers which can be used in the present invention other than the gelatin, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.). Among them, polyvinyl alcohols are preferably used.

The polyvinyl alcohol used in the present invention includes, for example, PVA-105,PVA-110,PVA-117,PVA-120,PVA-124,PVA-203,PVA-204,PVA-205, PVA-210,PVA-217,PVA-220,PVA-224,PVA-228,PVA-235,PVA-403, PVA-405 (all trade names, manufactured by KURARAY CO., LTD).

Among the preferred water-soluble polymers mentioned above, it is preferable to use the polyvinyl alcohols and gelatins. These can be used singly or in the mixture thereof, and more preferably, the gelatin is used.

The coating amount of the heat insulation layer used in the present invention is preferably 5.0 to 40.0 g/m$^2$, more preferably 10.0 to 30.0 g/m$^2$.

<Subbing Layer>

It is preferable that the heat-sensitive transfer image-receiving sheet of the present invention have a subbing layer between the support and the heat insulation layer. The subbing layer is a layer that is appropriately provided, for example, for the purpose of imparting an adhesiveness to the upper and lower layers provided on the subbing layer, or for the purpose of imparting a cushioning property to the image-receiving sheet. The subbing layer is distinguished from an undercoat layer that is coated preliminarily on the support.

A preferred embodiment of the subbing layer is the same as that described in the section <Intermediate layer>, and the constitutions of the subbing layer and the intermediate layer may be identical or different from each other. It is particularly preferable to incorporate the resin containing a butadiene component as a repeating unit, into the subbing layer. It is preferable that the subbing layer contains the resin containing a butadiene component as a repeating unit in an amount of 80% by mass or more, and most preferably in an amount of from 90% by mass to 95% by mass. This is a preferable embodiment for improving the color unevenness caused by the platen roller.

The subbing layer is different from the intermediate layer in the point that the influence of the heat applied from the thermal head is less. However, the subbing layer has an action of further increasing the occurrence of the color unevenness, which is caused by the variation in the pressing pressure of the platen roller. The glass transition temperature (Tg) of the resin containing a butadiene component as a repeating unit, which is preferable for the subbing layer, is preferably from 0° C. to 30° C., more preferably from 0° C. to 25° C., and most preferably from 0° C. to 15° C.

Examples of the resin containing a butadiene component as a repeating unit include a styrene-butadiene copolymer (styrene-butadiene rubber (SBR)), an acrylonitrile-butadiene copolymer (NBR latex), a methyl methacrylate-butadiene copolymer (MBR latex), and a styrene-butadiene-acrylic copolymer. Among these, SBR, NBR and MBR are preferred, and SBR is most preferred from the viewpoint of maintaining the elasticity of the intermediate layer. Furthermore, an SBR latex can be preferably used as the SBR.

These resins can be used singly or as mixtures of two or more kinds thereof, according to the necessity.

Specific examples of the resin containing a butadiene component as a repeating unit, which is preferable for the subbing layer, include SR-104 (trade name) manufactured by Nippon A&L, Inc.

The dry film thickness of the subbing layer in the present invention is preferably 0.5 to 10.0 μm, and more preferably 1.0 to 5.0 μm.

For example, a white background controlling layer, a charge controlling layer, an adhesive layer, and a primer layer may be formed other than above. These layers may be formed in the same manner as those described in, for example, each specification of Japanese Patent Nos. 3585599 and 2925244.

<Support>

As the support that is used for the heat-sensitive transfer image-receiving sheet of the present invention, there may be used ordinary supports. Among them, a water-proof support is preferably used. The use of the water-proof support makes it possible to prevent the support from absorbing moisture, whereby a fluctuation in a performance of the receptor layer with the lapse of time can be prevented. As the water-proof support, for example, a coated paper, a laminate paper or a synthetic paper may be used. Among them, a laminate paper is preferable.

It is conventional that the undercoat layer is preliminary coated on the support.

<Curl Controlling Layer>

It is preferable to form a curl controlling layer on the heat-sensitive transfer image-receiving sheet of the present invention, according to the necessity. For the curl controlling layer, a polyethylene laminate, a polypropylene laminate or the like is used. Specifically, the curl controlling layer may be formed in the same manner as those described in, for example, JP-A-61-110135 and JP-A-6-202295.

<Writing Layer and Charge Controlling Layer>

A writing layer and a charge controlling layer may be provided on the heat-sensitive transfer image-receiving sheet of the present invention, according to the necessity. For the writing layer and the charge controlling layer, an inorganic oxide colloid, an ionic polymer, an antistatic agent or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge controlling layer may be formed, for example, in a manner similar as those described in the specification of Japanese Patent No. 3585585.

<Other Additive>

The heat-sensitive transfer image-receiving sheet of the present invention may also contain an additive in the layers other than the receptor layer, according to the necessity. Examples of the additive include, in addition to the releasing agent described above, an ultraviolet absorbent, a surfactant, an antiseptic agent, a film-forming aid, a film-hardening agent, a matting agent (including a lubricating agent), an oxidation inhibitor, and other additives.

Ultraviolet Absorbent:

The heat-sensitive transfer image-receiving sheet of the present invention may contain any ultraviolet absorbents. As the ultraviolet absorbents, use can be made of ordinary inorganic or organic ultraviolet absorbents. As the organic ultraviolet absorbents, use can be made of non-reactive ultraviolet absorbents such as salicylate-series, benzophenone-series, benzotriazole-series, triazine-series, substituted acrylonitrile-series, and hindered amine-series ultraviolet absorbents; copolymers or graft polymers of thermoplastic resins (e.g., acrylic resins) obtained by introducing an addition-polymerizable double bond (e.g., a vinyl group, an acryloyl group, a methacryloyl group), or an alcoholic hydroxyl group, an amino group, a carboxyl group, an epoxy group, an isocyanate group, or the like, to the non-reactive ultraviolet absorbents, subsequently copolymerizing or grafting. In addition, disclosed is a method of obtaining ultraviolet-shielding resins by the steps of dissolving ultraviolet absorbents in a monomer or oligomer of the resin to be used, and then polymerizing the monomer or oligomer (JP-A-2006-21333). Thus-obtained ultraviolet shielding resins may be used. In this case, the ultraviolet absorbents may be non-reactive.

Of these ultraviolet absorbents, preferred are benzophenone-series, benzotriazole-series, and triazine-series ultraviolet absorbents. It is preferred that these ultraviolet absorbents are used in combination so as to cover an effective ultraviolet absorption wavelength region according to a property of the dye that is used for an image formation. Besides, in the case of the non-reactive ultraviolet absorbents, it is preferred to use a mixture of two or more kinds of ultraviolet absorbents each having a different structure from each other so as to prevent the ultraviolet absorbents from precipitating.

Examples of commercially available ultraviolet absorbents include TINUVIN-P (trade name, manufactured by Ciba-Geigy), JF-77 (trade name, manufactured by JOHOKU CHEMICAL Co., Ltd.), SEESORB 701 (trade name, manufactured by SHIRAISHI CALCIUM KAISHA, Ltd.), SUMISORB 200 (trade name, manufactured by Sumitomo Chemical Co., Ltd.), VIOSORB 520 (trade name, manufactured by KYODO CHEMICAL Co., Ltd.), and ADKSTAB LA-32 (trade name, manufactured by ADEKA).

Surfactant:

Further, in the heat-sensitive transfer image-receiving sheet of the present invention, a surfactant may be contained in any of such layers as a receptor layer, a heat insulation layer, and an intermediate layer.

An addition amount of the surfactant is preferably from 0.01% by mass to 5% by mass, more preferably from 0.01% by mass to 1% by mass, and especially preferably from 0.02% by mass to 0.2% by mass, based on the total solid content. With respect to the surfactant, various kinds of non-fluorinated surfactants such as anionic, nonionic and cationic surfactants are known. As the surfactant that can be used in the present invention, any known surfactants may be used. For example, it is possible to use surfactants as reviewed in "Kinosei kaimenkasseizai (Functional Surfactant)", editorial supervision of Mitsuo Tsunoda, edition on August in 2000, Chapter 6.

Antiseptic:

To the heat-sensitive transfer image-receiving sheet of the present invention, antiseptics may be added. The antiseptics that may be contained in the image-receiving sheet of the present invention are not particularly limited. For example, use can be made of materials described in Bofubokabi (Preservation and Antifungi) HAND BOOK, Gihodo shuppan (1986), Bokin Bokabi no Kagaku (Chemistry of Anti-bacteria and Anti-fungi) authored by Hiroshi Horiguchi, Sankyo Shuppan (1986), Bokin Bokabizai Jiten (Encyclopedia of Antibacterial and Antifungal Agent) edited by The Society for Antibacterial and Antifungal Agent, Japan (1986). Examples thereof include imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, derivatives such as guanidine, diazine, triazole derivatives, oxazole, oxazine derivatives, and 2-mercaptopyridine-N-oxide or its salt. Of these antiseptics, 4-isothiazoline-3-on derivatives and benzoisothiazoline-3-on are preferred.

Film-Forming Aid:

It is preferable to add a high boiling point solvent to the heat-sensitive transfer image-receiving sheet of the present invention. The high boiling point solvent is an organic compound (typically, an organic solvent) which functions as a film-forming aid or a plasticizer, and lowers the lowest film-forming temperature of the latex polymer, and such solvents are described in, for example, "Gosei Latex no Kagaku (Chemistry of Synthetic Latex)", Soichi Muroi, issued by Kobunshi Kanko Kai (1970). Examples of the high boiling point solvent (film-forming aid) include the following compounds.

Z-1: Benzyl alcohols

Z-2: 2,2,4-Trimethylpentanediol-1,3-monoisobutyrates

Z-3: 2-Dimethylaminoethanols

Z-4: Diethylene glycols

When these high boiling point solvents are added to the image-receiving sheet, spread of image is observed, and there is a case not preferable for practical use. However, if the solid content of the solvents in the coating film is not too large, there is no problem in terms of performance.

Hardening Agent:

The heat-sensitive transfer image-receiving sheet of the present invention may contain a hardening agent. The hardening agent may be added to a coated layer (such as a receptor layer, a heat insulation layer, and a subbing layer) of the heat-sensitive transfer image-receiving sheet.

Preferable examples of the hardening agent that can be used in the present invention include H-1, 4, 6, 8, and 14 in JP-A-1-214845 in page 17; compounds (H-1 to H-54) represented by one of formulae (VII) to (XII) in U.S. Pat. No. 4,618,573, columns 13 to 23; compounds (H-1 to H-76) represented by formula (6) in JP-A-2-214852, page 8, the lower right (particularly, H-14); and compounds described in claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), a boric acid, a metaboric acid, or a polymer hardening agent (compounds described, for example, in JP-A-62-234157), can be mentioned. Preferable examples of the hardener include a vinyl sulfone-series hardening agent and chlorotriazines.

Matting Agent:

To the heat-sensitive transfer image-receiving sheet of the present invention, a matting agent may be added in order to prevent blocking, or to give a release property and a sliding property. The matting agent may be added on the same side as the coating side of the receptor layer, or on the side opposite to the coating side of the receptor layer, or on both of the sides, in the image-receiving sheet.

Examples of the matting agent generally include fine particles of water-insoluble organic compounds and fine particles of inorganic compounds. In the present invention, the organic compound-containing fine particles are preferably used from the viewpoints of dispersion properties. In so far as the organic compound is incorporated in the particles, there may be organic compound particles consisting of the organic compound alone, or alternatively organic/inorganic composite fine particles containing not only the organic compound but also an inorganic compound. As the matting agent, there can be used organic matting agents described in, for example, U.S. Pat. Nos. 1,939,213, 2,701,245, 2,322,037, 3,262,782, 3,539,344, and 3,767,448.

[Preparation Method of Heat-Sensitive Transfer Image-Receiving Sheet]

The preferable preparation method of the heat-sensitive transfer image-receiving sheet of the present invention is explained below.

The heat-sensitive transfer image-receiving sheet of the present invention has at least one heat insulation layer and at least one receptor layer, and has at least one intermediate layer between the heat insulation layer and the receptor layer. It is preferable to carry out the preparation method such that the respective coating liquids for the layers are coated by a simultaneous multi-layer coating on the support.

Such the simultaneous multi-layer coating is preferably an aqueous type coating. The so-called "aqueous type" here means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

It is known that in the case of producing an image-receiving sheet composed of plural layers having different functions from each other (for example, a heat insulation layer, an intermediate layer and a receptor layer) on a support, it may be produced by applying each layer successively one by one, or by overlapping the layers each already coated on a support or substrate, as shown in, for example, JP-A-2004-106283, JP-A-2004-181888 and JP-A-2004-345267. On the other hand, it has been known, in photographic industries, that productivity can be greatly improved, for example, by providing plural layers through the simultaneous multi-layer coating. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050 ("JP-B" means examined Japanese patent publication); and Edgar B. Gutoff, et al., "Coating and Drying Defects: Troubleshooting Operating Problems", John Wiley & Sons Company, 1995, pp. 101-103.

In these coating methods, plural coating liquids are simultaneously supplied to coating apparatus, thereby to form plural layers different in kinds.

As the method of producing the heat-sensitive transfer image-receiving sheet of the present invention, a simultaneous multiple-layer coating can be carried out, and from the viewpoint of being capable of realizing a high productivity, a slide coating or a curtain coating is preferred. The heat-sensitive transfer image-receiving sheet of the present invention is generally produced by coating at least one receptor layer and at least one heat insulation layer, on a support by an aqueous coating. In the case where those layers are respectively constituted of multiple layers, or in the case where the heat-sensitive transfer image-receiving sheet has an intermediate layer or a subbing layer, it is preferable to simultaneously coat all of the layers, including the intermediate layer and the subbing layer, on the support.

In regard to the simultaneous multiple-layer coating, it is necessary to adjust the viscosity and surface tension of the coating liquids to form the respective layers, from the viewpoint of an uniform coated layer formation and a satisfactory coatability. The viscosity of the coating liquid can be readily adjusted by using a usual thickening agent or thinning agent to the extent that these agents do not affect other performances. Further, the surface tension of the coating liquid can be adjusted by means of various surfactants.

The temperature of these coating liquids for coating various layers is preferably 25° C. to 60° C., and more preferably 30° C. to 50° C. Particularly, the temperature of the coating liquids in the case of using a gelatin in the coating liquid is preferably 33° C. to 45° C.

In the present inventions, the coated amount of the coating liquid for a layer that constructs the multilayer constitution is preferably in the range of 1 $g/m^2$ to 500 $g/m^2$. The number of layers in the multilayer constitution can be arbitrarily selected to be two or more. It is preferable that the receptor layer is provided as a layer disposed farthest from the support.

In the drying zone, drying proceeds through: the constant rate period of drying, in which the drying rate is constant, and the material temperature is approximately equal to the wet-bulb temperature; and a falling rate period of drying, in which the drying rate are slowed, and the material temperature rises. In the constant rate drying period, any heat supplied from an external source is all used in the evaporation of moisture. In the falling rate drying period, moisture diffusion inside the material becomes rate-limiting, and the drying rate is lowered due to recession of the evaporation surface or the like. The supplied heat is used in the rising of the material temperature.

In the setting zone and drying zone, moisture migration occurs between the respective coated films (coated layers) and between the support and the coated films, and solidification also occurs due to cooling of the coated films and moisture evaporation. For those reasons, the quality and performance of the resultant product is greatly influenced by the processing history, such as the layer surface temperature during drying and the drying period of time, and it is required to set the conditions in accordance with the demanded quality.

The temperature of the setting zone is generally 15° C. or below, and it is preferable to set the cooling step time period in the range from 5 seconds to less than 30 seconds. If the cooling time period is too short, a sufficient increase of the coating liquid viscosity cannot be obtained, and the surface state is deteriorated upon the subsequent drying step. On the other hand, if the cooling time period is too long, the removal of moisture in the subsequent drying step takes time, and the production efficiency is decreased.

After the cooling step at 15° C. or below, drying is carried out in an environment at above 15° C. In that case, in the present invention, it is preferable to adjust the amount of evaporation of water in the coated films that have been coated in multiple layers within 30 seconds after the completion of cooling, to 60% or more of the amount of moisture contained in the layer surface smeared per an area of 1 $m^2$ immediately after coating. The terms "amount of moisture contained in the layer surface smeared per an area of 1 $m^2$ immediately after coating", is equal to the water content in the coating liquid prepared before the coating. When the amount of evaporating moisture is not so small, moisture is present on the coated surface not in excess, and the surface state is satisfactory.

On the other hand, in the case of adjusting the amount of evaporation to 60% or more, when the drying temperature is brought to a temperature not so higher than 50° C., the evaporation of moisture does not occur rapidly, without causing cracking or the like, and the surface state is satisfactory. Thus, it is preferable to control the drying temperature to 50° C. or below.

Determination of the amount of evaporation can be carried out such that the mass obtained by drying the heat-sensitive transfer image-receiving sheet after coating under the condition (in an atmosphere) of 110° C. for one hour, is defined as the mass after 100% evaporation, and the difference between the masses before and after drying are measured.

The dried coating-finished product is adjusted to have a certain water content, followed by winding up. Since the progress of film hardening is affected by the water content and temperature during the storage of the wound, coating-finished product, it is necessary to set the conditions for humidification step that are appropriate for the water content in a wound-up state.

In general, the film-hardening reaction can be carried out more easily at higher temperature and higher humidity conditions. However, if the water content is too high, adhesion between the coated products may occur, or there may be a problem in terms of performance. For this reason, it is necessary to set the water content in the wound-up state (humidification conditions) and the storage conditions in accordance with the product quality.

Typical drying devices include an air-loop system, a helical system, and the like. The air-loop system is a system in which drying blasts are made to blow on the coated product supported by rollers, and wherein a duct may be mounted either longitudinally or transversely. Such a system has a high degree of freedom in setting of the volume of drying wind, because a drying function and a transporting function are basically separated therein. However, many rollers are used therein, so base-transporting failures, such as gathering, wrinkling and slipping, tend to occur. The helical system is a system in which the coated product is wound round a cylindrical duct in a helical fashion, and transported and dried as it is floated by drying wind (air floating). So no support by rollers is basically required (JP-B-43-20438). In addition to those, there is available a drying system which conveys by reciprocally installing upper and lower ducts and conveying the coated product. In general, this system has a better dryness distribution than that of the helical system, but is poor in floatability.

[Image-Forming Method]

In the image-forming method (system) using the heat-sensitive transfer image-receiving sheet of the present invention, an image is formed by superposing a heat-sensitive transfer sheet on the heat-sensitive transfer image-receiving sheet of the present invention so that a dye layer (heat transfer layer) of the heat-sensitive transfer sheet is in contact with a receptor layer of the heat-sensitive transfer image-receiving sheet and giving thermal energy in accordance with image signals given from a thermal head.

Specifically, image-forming can be conducted by the similar manner to that as described in, for example, JP-A-2005-88545. In the present invention, a printing time is preferably less than 15 seconds, and more preferably in the range of 3 to 12 seconds, and further preferably 3 to 7 seconds, from the viewpoint of shortening a time taken until a consumer gets a print.

In order to accomplish the above-described printing time, a line speed at the time of printing is preferably 2.0 msec/line or less, and more preferably 1.5 msec/line or less, still more preferably 0.73 msec/line or less, most preferably 0.65 msec/line or less. Further, from the viewpoint of improvement in transfer efficiency as one of speeding-up conditions, the highest temperature of the thermal head at the time of printing is preferably in the range of from 180° C. to 450° C., more preferably from 200° C. to 450° C., and furthermore preferably from 350° C. to 450° C.

The heat-sensitive transfer image-receiving sheet of the present invention may be utilized for printers, copying machines and the like, which employs a heat-sensitive transfer recording system. As a means for providing heat energy in the thermal transfer, any of the conventionally known providing means may be used. For example, application of a heat energy of about 5 to 100 mJ/$mm^2$ by controlling recording time in a recording device such as a thermal printer (trade name: Video Printer VY-100, manufactured by Hitachi, Ltd.) can attain the image-formation. Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

[Heat-Sensitive Transfer]

The heat-sensitive transfer sheet is a sheet provided, on a support such as polyethylene terephthalate (PET), with coloring material layers formed by dispersing coloring materials of three colors: yellow, magenta and cyan, respectively, in a binder resin, and a transferable protective layer in area order. The coloring material layers may also be composed of layers of four colors, including black in addition to the three colors.

The term "forming layers in area order" as used in the present specification means forming dye layers each having a different hue and/or function layers in the longitudinal direction on the support of the heat-sensitive transfer sheet, by applying them separately in order.

Examples include the case in which a yellow dye layer, a magenta dye layer, and a cyan dye layer are formed in this order in the longitudinal direction on the support.

Further, any arrangement of these dye layers can be employed, but it is preferred that a yellow dye layer, a magenta dye layer, and a cyan dye layer be arranged sequentially in this order on the support.

(Binder Resin)

Examples of the binder resins used in the heat-sensitive transfer sheet include acrylic resins such as polyacrylonitrile, polyacrylate, and polyacrylamide; polyvinyl acetal-series resins such as polyvinyl acetoacetal, and polyvinyl butyral; cellulose-series resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. These may be used alone, or two or more thereof may be used in the form of a mixture or copolymer.

(Dye)

The dye is not limited, as long as it is able to diffuse by heat and able to be incorporated in a heat-sensitive transfer sheet, and able to transfer by heat from the heat-sensitive transfer sheet to an image-receiving sheet. As the dye used for the heat-sensitive transfer sheet, ordinarily used dyes or known dyes can be used.

Preferable examples of the dye include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of a yellow dye include Disperse Yellow 231, Disperse Yellow 201 and Solvent Yellow 93. Specific examples of a magenta dye include Disperse Violet 26, Disperse Red 60, and Solvent Red 19. Specific examples of a cyan dye include Solvent Blue 63, Solvent Blue 36, Disperse Blue 354 and Disperse Blue 35. As a matter of course, it is also possible to use suitable dyes other than these dyes as exemplified above. Further, dyes each having a different hue from each other as described above may be arbitrarily combined together.

(Heat Transferable Protective Layer)

A heat transferable protective layer (laminate) is used for forming a protective layer composed of a transparent resin on a thermally transferred image by thermal transfer and thus covering and protecting the image, thereby to improve durability such as scratch resistance, light-fastness, and resistance to weather. This layer (laminate) is preferably formed in the case where the transferred dye may be insufficient in image durabilities such as light resistance, scratch resistance, and chemical resistance in the state that the dye is naked in the surface of an image-receiving sheet. As one example of the heat-transferable protective layer, a releasing layer, a protective layer, and an adhesive layer may be formed on a polyethylene terephthalate (PET) support in this order from the support side. The protective layer may be formed by plural layers. In the case where the protective layer also has functions of other layers, the releasing layer and the adhesive layer can be omitted. As a support, it is also possible to use a support on which an easy adhesive is already formed.

As a protective layer-forming resin, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, mixtures of these resins, ionizing radiation-curable resins, and ultraviolet-shielding resins. In addition, there can be used various kinds of resins that are conventionally known as the protective layer-forming resin. Further, in order to give ultraviolet absorbing capacity, or to improve coat separation properties at the time of transfer, gloss, brightness, or the like, it is also preferred to add ultraviolet absorbing agents, antioxidants, fluorescent brightening agents, organic fillers and/or inorganic fillers, and the like in accordance with the necessity.

Depending on the kind of the protective layer-forming resin, the protective layer is formed by the same method as the method of forming the above-described dye layer. The thickness of the protective layer is preferably in the range of from about 0.5 μm to about 10 μm.

In the case where the protective layer is difficult to separate from a support at the time of transfer, it is also a preferable embodiment to form a release (releasing) layer between the support and the protective layer. The release layer can be formed by the steps of preparing a coating liquid composed of a material that is excellent in release properties, such as waxes, silicone wax, silicone resin, and fluorine resin; a relatively high softening point resin that does not melt by heat from a thermal head, such as cellulose-based resin, acrylic resin, polyurethane resin, polyvinyl acetal resin, acrylic vinyl ether-based resin, maleic acid anhydride resin, silicone resin, fluorine resin; or the above-described resins containing a heat release agent such as waxes, and then coating the coating liquid according to a conventionally known coating method such as gravure coat and gravure reverse coat, followed by drying. Of these resins, preferred are acrylic resins obtained by polymerizing acrylic acid or methacrylic acid singly, or copolymerizing acrylic acid or methacrylic acid with other monomers. These acrylic resins are excellent in adhesion to the support, and release properties from the protective layer. Further, these resins may be used alone or in the combination of these resins.

The release layer remains at the side of a support such as a PET at the time of printing (transfer).

The thickness of the release layer is preferably in the range of from about 0.5 μm to about 5 μm. Various kinds of particles are incorporated in the release layer, or alternatively the surface of the release layer at the protective layer-coating side is subjected to a mat treatment, thereby to mat the surface of the release layer. Resultantly, the surface of the image-receiving sheet after printing can be mat-finished (flatten).

A separation layer may be formed between the transferable protective layer and the release layer. The separation layer is transferred together with the protective layer. After transfer, the separation layer becomes the outermost layer of the printed image-receiving sheet. Thus, the separation layer is composed of a resin that is excellent in transparency, abrasion resistance and chemical resistance. As the resin, there are exemplified acrylic resin, epoxy resin, polyester resin, styrene resin, and the like. Further, additives such as fillers and waxes may be added to the separation layer.

A preferred specific embodiment of the heat-sensitive transfer image-receiving sheet of the present invention is shown in FIG. 1 as a cross-sectional view.

In FIG. 1, 1 represents the support, 2 represents the subbing layer, 3 represents the heat insulation layer, and 4 represents the intermediate layer provided between the receptor layer 5 and the heat insulation layer 3. 10 represents the heat-sensitive transfer image-receiving sheet. In the following Examples, a heat-sensitive transfer image-receiving sheet was produced based on the layer constitution of this embodiment.

The present invention is contemplated for providing a heat-sensitive transfer image-receiving sheet that is capable of obtaining a high dye transfer density and hardly raises a problem of the color unevenness caused by a platen roller.

The heat-sensitive transfer image-receiving sheet according to the present invention exhibits excellent operating effects that a high dye transfer density is obtained, and a problem of the occurrence of the color unevenness caused by the pressing of the platen roller hardly occurs even if a large number of printed matters are produced.

EXAMPLES

The present invention will be described in more detail based on the following examples. Any materials, reagents, amount and ratio of use and operations, as shown in the examples, may appropriately be modified without departing from the spirit and scope of the present invention. It is therefore understood that the present invention is by no means intended to be limited to the specific examples below. In the following Examples, the terms "part" and "%" are values by mass, unless they are indicated differently in particular.

Comparative Example 1

[Sample 1]

A paper support, on both sides of which a polyethylene was laminated, was subjected to corona discharge treatment on the surface thereof, and then a gelatin undercoat layer containing a sodium dodecylbenzenesulfonate was disposed on the treated surface. A subbing layer, a heat insulation layer and a receptor layer each having the following composition were simultaneously multilayer-coated on the gelatin undercoat layer, in the state that the subbing layer, the heat insulation layer and the receptor layer were laminated in this order from the side of the support, by a slide coating method, to produce a heat-sensitive transfer image-receiving sheet (Sample 1). The flow rates of the slide coating system were set up so that the thickness of each layer after drying was 2.5 μm for the subbing layer, 20 μm for the heat insulation layer, and 0.8 μm for the receptor layer.

Comparative Example 2

[Sample 2]

A heat-sensitive transfer image-receiving sheet (Sample 2) was prepared by performing simultaneous multilayer-coating by a slide coating method, in the state that a subbing layer, a heat insulation layer, an interlayer (intermediate layer) and a receptor layer, each having the following composition, were laminated on a paper support obtained by the same method as Sample 1, in the aforementioned order from the side of the support. The flow rates of the slide coating system were set up so that the thickness of each layer after drying was 2.5 μm for the subbing layer, 20 μm for the heat insulation layer, and 2.1 μm for the interlayer, and 0.8 μm for the receptor layer. In addition, the interlayer coating liquid 1 shown below was used for the interlayer.

Example 1

[Sample 3]

A heat-sensitive transfer image-receiving sheet (Sample 3) was prepared in the same manner as Sample 2, except that the following coating liquid 2 for interlayer was used for the interlayer.

Comparative Example 3

[Sample 4]

A heat-sensitive transfer image-receiving sheet (Sample 4) was prepared in the same manner as Sample 3, except that the flow rate for the interlayer coating liquid was set up such that the interlayer thickness after drying would be 1.5 μm, and the total dry thickness of the receptor layer and the interlayer was adjusted to 2.3 μm.

Example 2

[Sample 5]

A heat-sensitive transfer image-receiving sheet (Sample 5) was prepared in the same manner as Sample 3, except that the flow rate for the interlayer coating liquid was set up such that the interlayer thickness after drying would be 3.0 μm, and the total dry thickness of the receptor layer and the interlayer was adjusted to 3.8 μm.

Comparative Example 4

[Sample 6]

A heat-sensitive transfer image-receiving sheet (Sample 6) was prepared in the same manner as Sample 3, except that the flow rate for the interlayer coating liquid was set up such that the interlayer thickness after drying would be 3.7 μm, and the total dry thickness of the receptor layer and the interlayer was adjusted to 4.5 μm.

Comparative Example 5

[Sample 7]

A heat-sensitive transfer image-receiving sheet (Sample 7) was prepared in the same manner as Sample 3, except that the thickness of the receptor layer was adjusted to 2.4 μm, and the total dry thickness of the receptor layer and the interlayer was adjusted to 4.5 μm.

Comparative Example 6

[Sample 8]

A heat-sensitive transfer image-receiving sheet (Sample 8) was prepared in the same manner as Sample 3, except that the following coating liquid 3 for interlayer was used for the interlayer.

Example 3

[Sample 9]

A heat-sensitive transfer image-receiving sheet (Sample 9) was prepared in the same manner as Sample 3, except that the following coating liquid 4 for interlayer was used for the interlayer.

Example 4

[Sample 10]

A heat-sensitive transfer image-receiving sheet (Sample 10) was prepared in the same manner as Sample 3, except that the following coating liquid 5 for interlayer was used for the interlayer.

Comparative Example 7

[Sample 11]

A heat-sensitive transfer image-receiving sheet (Sample 11) was prepared in the same manner as Sample 3, except that the following coating liquid 6 for interlayer was used for the interlayer.

(Composition)

Coating Liquid 1 for Receptor Layer:

| | |
|---|---|
| Vinyl chloride-series copolymer latex polymer (solids concentration: 36% by mass) (trade name: Vinybran 900, manufactured by Nissin Chemicals Co., Ltd., Vinyl chloride/acrylate copolymer, Tg: 70° C.) | 40 mass parts |
| Gelatin (10% solution) | 2 mass parts |
| Polyether-modified silicone (side-chain type, trade name: L-7001, manufactured by Dow Corning Toray Co., Ltd.) | 1 mass part |
| Water | 54 mass parts |

(Composition)

Coating Liquid1 for Heat Insulation Layer:

| | |
|---|---|
| Acrylic-series hollow particles (solids concentration: 26.5%) (trade name: Rohpake HP-1055, manufactured by Rohm and Haas) | 25 mass parts |
| Gelatin (10% solution) | 50 mass parts |
| Water | 27 mass parts |

(Composition)

Coating Liquid 1 for Subbing Layer:

| | |
|---|---|
| Binder, polyvinyl alcohol manufactured by KURARAY CO., LTD, PVA235 (trade name) | 3 mass parts |
| Binder, SBR latex manufactured by NIPPON A & L INC., SR-104 (trade name, solid content: 48%, Tg: 3° C.) | 25 mass parts |
| Water | 27 mass parts |

(Composition)

Coating Liquid 1 for Interlayer:

| | |
|---|---|
| Binder, SBR latex manufactured by NIPPON A & L INC., SR-102 (trade name, solid content: 48%, Tg: 21° C.) | 25 mass parts |
| Gelatin (10% solution) | 2 mass parts |
| Water | 27 mass parts |

Coating Liquid 2 for Interlayer:

| | |
|---|---|
| Binder, SBR latex manufactured by NIPPON A & L INC., SR-115 (trade name, solid content: 48%, Tg: 37° C.) | 25 mass parts |
| Gelatin (10% solution) | 2 mass parts |
| Water | 27 mass parts |

Coating Liquid 3 for Interlayer:

| | |
|---|---|
| Binder, SBR latex manufactured by NIPPON A & L INC., SR-115 (trade name, Tg: 37° C., solid content: 48%) | 23 mass parts |
| Gelatin (10% solution) | 2 mass parts |
| Water | 27 mass parts |

Coating Liquid 4 for Interlayer:

| | |
|---|---|
| Binder, polyester resin manufactured by Toyobo Co., Ltd., MD1500 (trade name, Tg: 77° C., solid content: 30%) | 25 mass parts |
| Gelatin (10% solution) | 2 mass parts |
| Water | 27 mass parts |

Coating Liquid 5 for Interlayer:

| | |
|---|---|
| Binder, polyester resin manufactured by Toyobo Co., Ltd., MD1200 (trade name, Tg: 67° C., solid content: 34%) | 25 mass parts |
| Gelatin (10% solution) | 2 mass parts |
| Water | 27 mass parts |

Coating Liquid 6 for Interlayer:

Binder, Polyurethane Manufactured by Dainippon Ink and Chemicals,

| | |
|---|---|
| Incorporated, HYDRAN AP40 (trade name, Tg: 37° C., solid content: 35%) | 25 mass parts |
| Gelatin (10% solution) | 2 mass parts |
| Water | 27 mass parts |

The layer constitutions of the respective heat-sensitive transfer image-receiving sheets (Samples 1 to 11) of Examples and Comparative examples are presented in Table 1.

(Image Formation and Density Measurement Test)

Fujifilm thermal photoprinter ASK-2000L (trade name, manufactured by Fujifilm Corporation) was used as a printer for image formation. Heat transfer sheets prescribed for the printer and the heat-sensitive transfer image-receiving sheets of Samples 1 to 11 were processed to be loadable, and full page printing under the setting of 102 Grey in the 256-monochromatic gradation display was carried out in a printing environment under the condition of 25° C. and 55%. The density at the printed surface was measured with SPRCTROLINO manufactured by Gretag Macbeth Imaging, Inc. A value of 0.85±0.05 is considered satisfactory. The results are shown in Table 1.

(Test for Evaluation of Longitudinal Direction Print Unevenness)

Heat transfer sheets prescribed for the printer and the heat-sensitive transfer image-receiving sheet of Samples 1 to 11 were processed to be loadable, and using a printer (ASK-2000L) which had been operated to produce 20,000 sheets or more of total print, the color unevenness of 102 Grey full page prints obtained under the condition of 15° C. and 20% RH was subjected to a sensory evaluation according to the following criteria. The results are shown in Table 1.

A: The grey color seems approximately uniform, and unevenness is not sensed.

B: Slight unevenness of the grey color can be observed, but the unevenness is at a level practically free of problem for actual use.

C: Some color unevenness is observed, which may cause a problem in actual use.

D: Clear unevenness of the grey color is observed, which may cause a problem in actual use.

Using a printer (ASK-2000L) which had been operated to produce 1000 sheets or fewer of total print, the color unevenness of 102 Grey full page prints obtained under the condition of 15° C. and 20% RH was subjected to a sensory evaluation according to the following criteria. All of the Samples were evaluated as grade A, and approximately uniform grey images were obtained.

TABLE 1

| | | CE 1 | CE 2 | Example 1 | CE 3 | Example 2 | CE 4 | CE 5 | CE 6 | Example 3 | Example 4 | CE 7 |
|---|---|---|---|---|---|---|---|---|---|---|---|---|
| Sample No. | | 1 | 2 | 3 | 4 | 5 | 6 | 7 | 8 | 9 | 10 | 11 |
| Heat insulation layer | | Present | Present | Present | Present | Present | Present | Present | Present | Present | Present | Present |
| Interlayer | | None | Present | Present | Present | Present | Present | Present | Present | Present | Present | Present |
| | Coating liquid No. | — | 1 | 2 | 2 | 2 | 2 | 2 | 3 | 4 | 5 | 6 |
| | Tg (° C.) | — | 21° C. | 37° C. | 37° C. | 37° C. | 37° C. | 37° C. | 37° C. | 77° C. | 67° C. | 49° C. |
| | Polymer kind | — | SBR | SBR | SBR | SBR | SBR | SBR | SBR | Polyester | Polyester | Poly-urethane |
| | Trade name | — | SR102 | SR115 | SR115 | SR115 | SR115 | SR115 | SR115 | MD1500 | MD1200 | AP40 |
| | Polymer content (mass %) | — | 92.6 | 92.6 | 92.6 | 92.6 | 92.6 | 92.6 | 85 | 92.6 | 92.6 | 92.6 |
| | Thickness (μm) | — | 2.1 | 2.1 | 1.5 | 3.0 | 3.7 | 2.1 | 2.1 | 2.1 | 2.1 | 2.1 |
| Receptor layer | Thickness (μm) | 0.8 | 0.8 | 0.8 | 0.8 | 0.8 | 0.8 | 2.4 | 0.8 | 0.8 | 0.8 | 0.8 |
| Total thickness of Interlayer and Receptor layer (μm) | | | 2.9 | 2.9 | 2.3 | 3.8 | 4.5 | 4.5 | 2.9 | 2.9 | 2.9 | 2.9 |
| Test for evaluation of longitudinal direction print unevenness | | D | A | B | D | A | A | A | C | B | B | C |
| Image formation and density measurement test | | 0.85 | 0.61 | 0.86 | 0.85 | 0.85 | 0.67 | 0.7 | 0.86 | 0.87 | 0.86 | 0.7 |

Please note that "CE" means "comparative example".

As shown in Table 1, Comparative examples 1, 3, 6 and 7 were evaluated as grade C or D in the test for evaluation of longitudinal direction print unevenness, which may cause a problem in actual use. Comparative examples 2, 4, 5 and 7 were found to have low densities in the density measurement test, which densities were out of the range defined above. On the contrary, the heat-sensitive transfer image-receiving sheets of Examples were all evaluated as grade A or B in the test for evaluation of longitudinal direction print unevenness, and were also found in the density measurement test to have their print densities within the range defined above. The Samples of Examples also resulted in high dye transfer densities, and hardly suffered from a problem of the color unevenness caused by the platen roller.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2009-225402 filed in Japan on Sep. 29, 2009, which is entirely herein incorporated by reference.

What we claim is:

1. A heat-sensitive transfer image-receiving sheet, comprising on a support:

at least one heat insulation layer; and at least one receptor layer containing a vinyl chloride-series latex copolymer in this order, wherein at least one intermediate layer is provided between the heat insulation layer and the receptor layer, wherein the total dry film thickness of the receptor layer and the intermediate layer is 2.5 to 4.0 μm, and wherein the intermediate layer contains 90 mass % or more of a polymer having a glass transition temperature of 30° C. or higher.

2. The heat-sensitive transfer image-receiving sheet according to claim 1, wherein the polymer having a glass transition temperature of 30° C. or higher is at least one selected from the group consisting of a resin containing a butadiene structure compound as a repeating unit and a polyester resin.

3. The heat-sensitive transfer image-receiving sheet according to claim 1, wherein the polymer having a glass transition temperature of 30° C. or higher is a styrene-butadiene rubber.

4. The heat-sensitive transfer image-receiving sheet according to claim 1, wherein the dry film thickness of the intermediate layer is 2.1 to 3.0 μm.

5. The heat-sensitive transfer image-receiving sheet according to claim 1, wherein the glass transition temperature of the vinyl chloride-series latex copolymer is from 50° C. to 100° C.

6. The heat-sensitive transfer image-receiving sheet according to claim 1, having a subbing layer between the support and the heat insulation layer.

7. The heat-sensitive transfer image-receiving sheet according to claim 1, wherein the intermediate layer contains a gelatin.

* * * * *